US005515875A

United States Patent [19]

Acker et al.

[11] Patent Number: 5,515,875

[45] Date of Patent: May 14, 1996

[54] LOOSE POWDER COMPACT

[76] Inventors: Stanley Acker, 7 Edgewater La., Nyack, N.Y. 10960; Frank Garcia, 7610 Narrows Ave., Brooklyn, N.Y. 11209

[21] Appl. No.: 327,936

[22] Filed: Oct. 24, 1994

[51] Int. Cl.[6] ..... A45D 33/24

[52] U.S. Cl. ..... 132/298; 132/295; 206/229; 206/235

[58] Field of Search ..... 206/229, 581, 206/235; 132/293–307

[56] References Cited

U.S. PATENT DOCUMENTS

| | | | |
|---|---|---|---|
| a,460,906 | 7/1923 | Hyde | 132/296 |
| 1,475,039 | 11/1923 | Turnquist | 132/305 |
| 1,534,870 | 4/1925 | Roystone | 132/294 |
| 1,615,487 | 1/1927 | Root | 132/307 |
| 1,630,437 | 5/1927 | Kjellstrom | 132/307 |
| 1,647,004 | 10/1927 | Hyde | 132/296 |
| 1,680,150 | 8/1928 | Humphrey | 132/307 X |
| 1,735,483 | 11/1929 | Wacker | 132/300 X |
| 1,794,602 | 3/1931 | Friedman | 132/298 |
| 1,804,808 | 5/1931 | Pretot | 132/306 X |
| 1,903,357 | 4/1933 | Friedman | 132/298 |
| 2,043,726 | 6/1936 | Bangs | 132/306 |
| 2,113,659 | 4/1938 | Le Blanc | 132/307 |
| 2,120,849 | 6/1938 | Almonte | 132/307 |
| 2,173,235 | 9/1939 | Nell | 206/229 |
| 2,527,169 | 10/1950 | Wiggins | 132/293 |
| 4,162,010 | 7/1979 | Hovsepian | 132/293 X |

FOREIGN PATENT DOCUMENTS

| | | | |
|---|---|---|---|
| 0376701 | 8/1907 | France | 132/307 |

*Primary Examiner*—Bryon P. Gehman
*Attorney, Agent, or Firm*—Baker & McKenzie

[57] ABSTRACT

An improved compact container for the storage and dispensing of loose cosmetic powder is provided. The container includes a base portion for accommodating and storing loose cosmetic powder. A retainer mateably engages an opening defined by the base portion. The retainer includes a lower perforated panel which provides for a controlled dispensing of the loose powder and an upper closure panel which folds over downward and closes the lower perforated panel to seal the powder below the upper closure panel when the compact is not in use. The design of the retainer also enables an applicator or powder brush to be stored on top of the container below the cover or top of the compact container to provide a compact and convenient kit for the storage, dispensing and use of loose cosmetic powder.

7 Claims, 2 Drawing Sheets

Fig. 1.
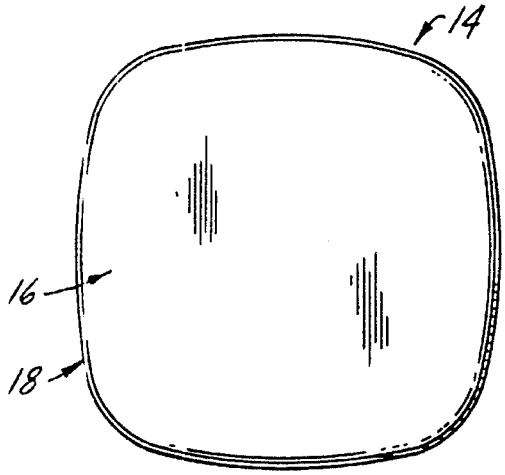
Fig. 3.
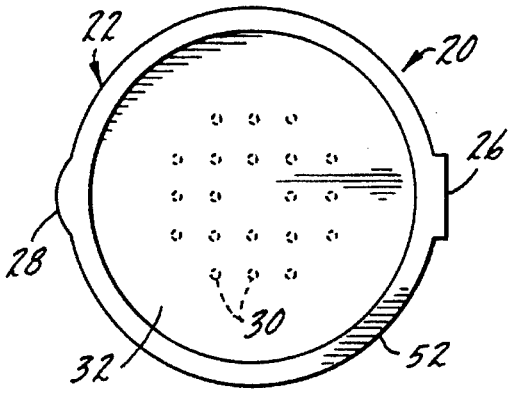
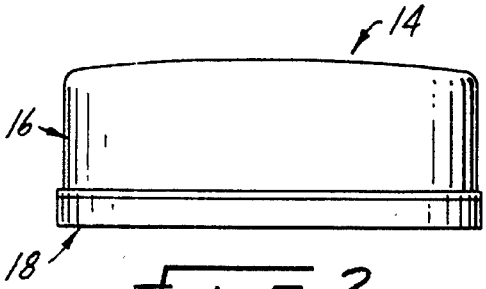
Fig. 2.
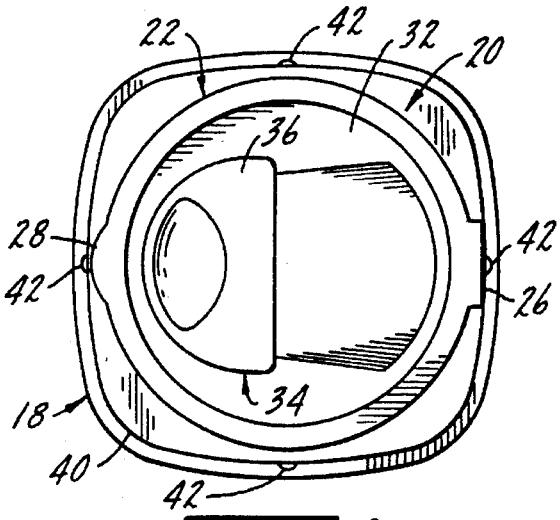
Fig. 4.
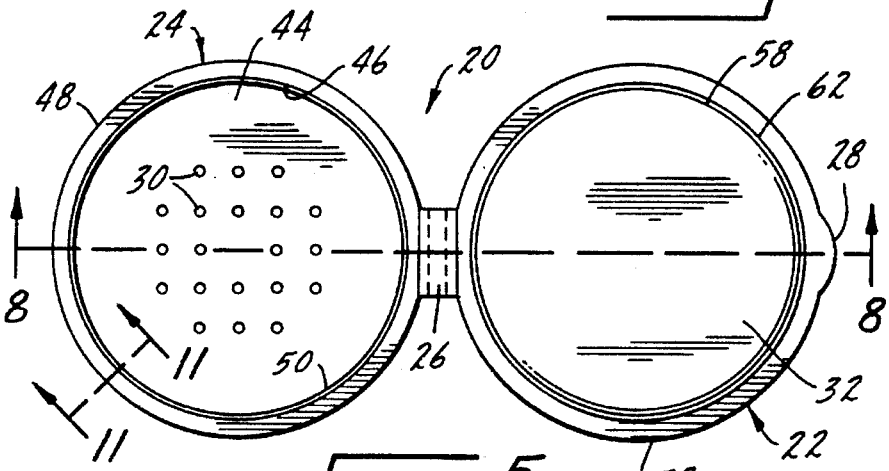
Fig. 5.

Fig. 6.
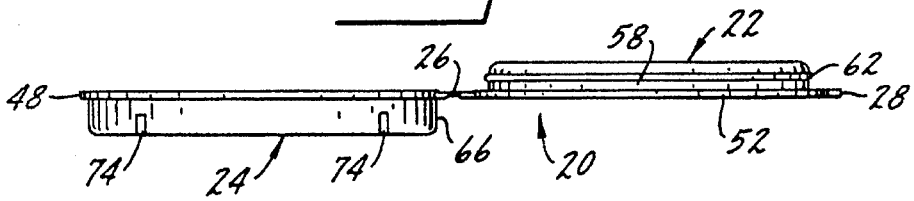
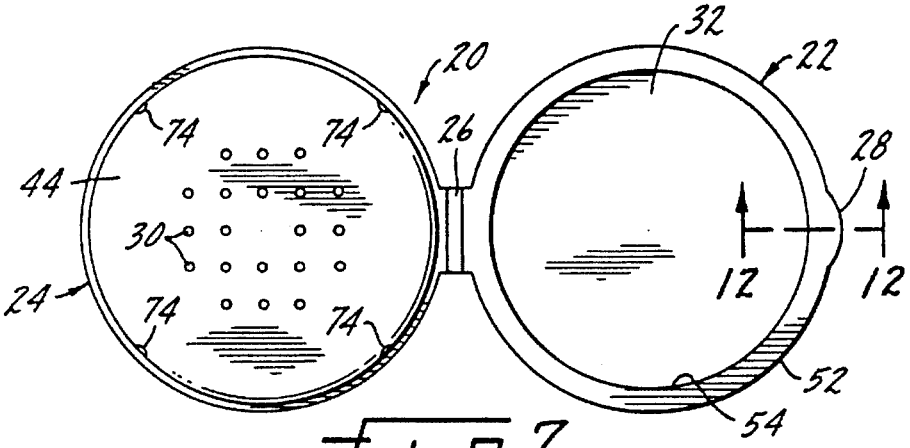
Fig. 7.
Fig. 8.
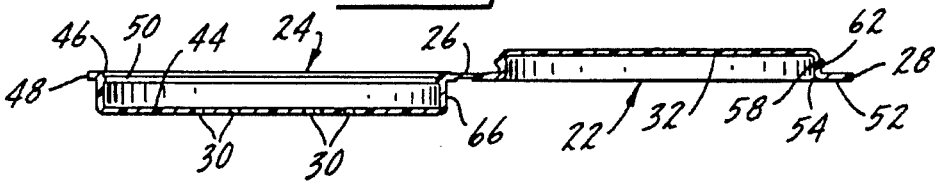
Fig. 9.
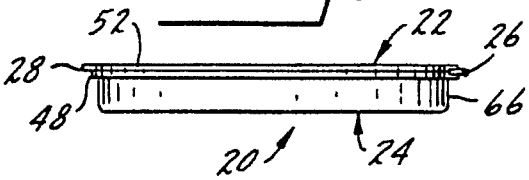
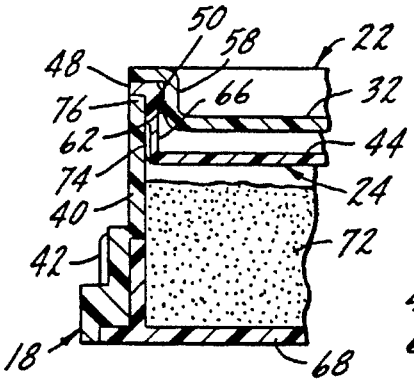
Fig. 10.
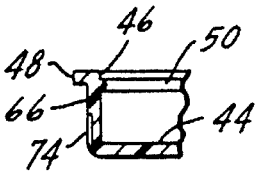
Fig. 11.
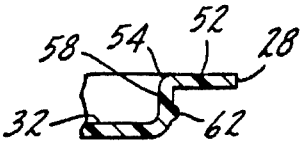
Fig. 12.
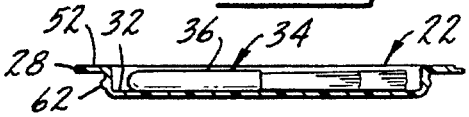
Fig. 13.

LOOSE POWDER COMPACT

FIELD OF THE INVENTION

This invention relates generally to containers for cosmetic face powder. More specifically, this invention relates to a container for loose cosmetic face powder as opposed to pressed cosmetic face powder. Still more specifically, the present invention relates to a compact for loose powder which includes a means for retaining the loose powder within the loose powder reservoir to prevent unwanted spillage of the loose powder, a means for storing an applicator brush within the compact and away from the loose powder and also a means for controllably dispensing the loose powder from the reservoir.

BACKGROUND

Cosmetic facial powder comes in two primary forms. One form is that of the pressed powder variety. Pressed powder is normally provided in a round or rectangular compact case that is relatively flat. The case normally comprises two opposing half shells; a first half shell accommodates the pressed powder and a second half shell accommodates a mirror to facilitate the application of the powder on the user's face. An application pad is normally housed between the two opposing half shells.

No special means for retaining or holding the pressed powder in place is necessary because the pressed powder consists of powder granules that are compressed together to form a cohesive unit. Therefore, the pressed powder maintains its position in its respective half shell until the user rubs the applicator pad on the pressed powder which causes some of the pressed powder to rub off onto the applicator pad. Then, the user simply rubs the applicator pad on the facial area. However, the compact containers used for pressed powder are unsatisfactory for loose powder because, as its name suggests, loose powder is loose and therefore will not maintain its position in one of the half shells if the compact is moved or tilted. A separate means for holding the powder in place is required.

The prior art compacts designed specifically for loose powder are only incrementally better than those designed for pressed powder. Specifically, currently available loose powder compacts include a base portion which serves as a cup or reservoir for the loose powder. A perforated plate is disposed over the opening of the reservoir and then a top or cover is provided to enclose both the base and perforated plate. This configuration is very inconvenient because the loose powder will migrate up through the perforations during handling or transport of the compact. While manufacturers often apply a label to the top of the perforations to seal the loose powder inside the base, once the consumer removes the label to use the powder, the powder will easily migrate up through the perforations during handling and transport. The result is loose powder being disposed on both sides of the perforations, some of which can partially spill out any time the compact is opened. The loose powder will also cover any applicator or brush disposed between the perforated plate and the top or cover including the handle portion of the brush which is frustrating to the users who want the powder applied to their faces, not their hands. Hence, it is more convenient to carry the applicator brush separately than inside the compact. However, carrying the applicator separately defeats part of the purpose of a loose powder "compact" which is supposed to be small and easily fit inside a small purse or handbag.

Thus, an improved compact for loose powder is needed. Preferably, the compact case should be provided that will enable a controlled dispensing of the loose powder from the reservoir while still providing a means for sealing or isolating of the loose powder from the rest of the compact so that an applicator or brush can be conveniently stored within the compact and further so that loose powder will not spill out of the compact every time the top or cover is removed.

SUMMARY OF THE INVENTION

The present invention satisfies the aforenoted needs by providing a loose powder compact that comprises a base or base receptacle that accommodates the loose powder. The base will normally have a upper rim which defines an opening for accommodating a retainer. The retainer, which comprises a substantial portion of the improvement contributed by the present invention, includes a lower perforated panel that is mateably engaged in the opening defined by the upper rim of the base. The retainer also includes an upper closure panel that can be mateably connected to the lower perforated panel. Thus, the lower perforated panel of the retainer is mateably engaged in the upper rim of the base which acts to hold the retainer in place and provide a perforated plate over the loose powder disposed therebelow. Further, to preclude loose powder from migrating through the perforations and contaminating the rest of the compact during handling and transport, the upper closure panel folds downward and mateably engages the lower perforated panel to seal the loose powder below the upper closure panel. Thus, while some loose powder will migrate upward through the perforations during handling and transport, the powder is retained below the upper closure panel.

A top may also be provided which fits over the retainer and mateably engages the base thereby providing a compact and convenient container for loose cosmetic powder. Further, the top may also provide enough space for the storage of an applicator brush or other application means between the upper closure panel and an undersurface of the top. Preferably, the upper closure panel of the retainer will include a recess for accommodating an applicator brush or applicator means. The undersurface of the top may also be configured to accommodate a brush or applicator.

It is therefore an object of the present invention to provide an improved compact container for accommodating loose cosmetic powder.

Yet another object of the present invention is to provide a loose powder compact that retains the loose powder within a confined reservoir so that a brush or applicator may be stored within the compact and still be isolated from the loose cosmetic powder.

Still another object of the present invention is to provide an improved receptacle for storing loose cosmetic powder and an applicator, together.

Yet another object of the present invention is to provide an improved, controlled and compact dispensing means for loose cosmetic powder that may be closed or sealed when not in use.

Other features and advantages of the present invention will appear from the following description in which one preferred embodiment has been set forth in detail in conjunction with the accompanying drawings.

BRIEF DESCRIPTION OF THE DRAWINGS

FIG. 1 is a top plan view of a loose powder compact made in accordance with the present invention;

FIG. 2 is a front plan view of the loose powder compact shown in FIG. 1;

FIG. 3 is a top plan view of the retainer assembly of the present invention in a closed position;

FIG. 4 is a top plan view of the loose powder compact, first shown in FIG. 1 with the top removed, and an applicator brush disposed on top of the upper closure member, first shown in FIG. 3;

FIG. 5 is a plan view of the retainer assembly first shown in FIG. 3 and in a open position;

FIG. 6 is a side plan view of the retainer assembly shown in FIG. 5;

FIG. 7 is a bottom plan view of the retainer assembly shown in FIG. 5;

FIG. 8 is a section view taken substantially along the line 8—8 of FIG. 5;

FIG. 9 is a side plan view of the retainer assembly first shown in FIG. 3, in a closed position;

FIG. 10 is a partial front sectional view of the loose powder compact shown in FIG. 2;

FIG. 11 is a partial side sectional view taken substantially along the line 11—11 of FIG. 5;

FIG. 12 is a partial side sectional view taken substantially along the line 12—12 of FIG. 7 and FIG. 13 is a sectional view of the applicator brush and upper closure member shown in FIG. 4.

It should be understood that the drawings are not necessarily to scale and that the embodiments are sometimes illustrated by graphic symbols and diagrammatic representations. In certain instances, details which are not necessary for understanding of the present invention or which render other details difficult to perceive may have been omitted. It should be understood, of course, that the invention is not necessarily limited to the particular embodiments illustrated herein.

DETAILED DESCRIPTION OF THE DRAWINGS

Like reference numerals will be used to refer to like or similar parts from figure to figure in the following description of the drawings.

The dramatic improvement contributed by the present invention is best understood after consideration of the prior art. Specifically, the loose powder compacts provided by the prior art feature a reservoir with some type of perforated plate or other controlled dispensing means disposed over the reservoir to provide a relatively controlled dispensing rate of the loose powder. However, the compacts taught by the prior art also include a separate top of closure mechanism which confines loose powder within the compact but also enables the loose powder to migrate through the perforated plate during transport and handling of the compact. When the consumer removes the top of the compact to access the loose powder, loose powder that has migrated through the perforations often spills out of the top of the compact and onto the user. Further, if an applicator brush or other applications means is stored underneath the top of the compact, the applicator is normally completely covered with loose powder which also acts to soil the hands of the user.

The present invention solves these problem by providing an improved retainer assembly that seals or retains the loose powder below the retainer assembly and inside the loose powder reservoir during the life of the compact. The retainer assembly may thereafter be opened to provide access to the loose powder and thereafter closed or sealed to isolate the loose powder. An applicator brush or other application means may be stored underneath the top of the compact in a position where it is isolated-from the loose powder when not in use.

Turning to FIG. 1, the loose powder compact 14 of the present invention is shown. As best seen in FIG. 2, the loose powder compact 14 includes a top 16 that is mateably engaged over a base or base receptacle 18. FIG. 3 provides a top plan view of the retainer assembly 20 in a closed position. The retainer assembly 20 includes a top or upper closure panel 22 which is hingedly connected to the lower perforated panel 24 (see FIG. 5) at the hinge 26. Still-referring to FIG. 3, the top or upper closure panel 22 features a tab 28 to facilitate the opening and closing of the top closure panel 22 over the lower perforated panel 24. FIG. 3 also shows the perforations indicated generally at 30 disposed in the lower perforated panel 24.

Turning to FIG. 4, a top plan view of the compact 14 is shown without the top 16. Preferably, the retainer 20 is accommodated in an opening in the base 18 with a friction fit. The top closure panel 22 can be folded downward to close over the lower perforated panel 24 (not shown in FIG. 4) to isolate the perforations and loose powder below the top closure panel 22. A recessed area or upper surface indicated generally at 32 of the top closure panel 22 is provided to accommodate an applicator or powder brush 34 other application means. In this manner, the brush 34 can be stored on top of the top closure panel 22 and be isolated from the perforations 30 and all of the loose powder is disposed below the lower perforated panel 24 so that the brush handle portion 36 remains relatively clean and free of loose powder. See also FIG. 13. Thus, the user can pick up the brush 34 by the handle 36 without getting loose powder on one's fingers. It will be noted from FIG. 4 that the base 18 includes an upwardly extending sidewall 40. The sidewall 40 includes a plurality of ribs indicated generally at 42 that enhance the friction fit between the sidewall 40 and the matching inside surface of the top 16 (not shown).

Turning to FIG. 5, the retainer assembly 20 is shown in detail. The lower perforated panel 24 includes a plurality of perforations 30 to provide controlled dispensing of the loose powder which is disposed below the lower panel 24 and within the base 18. As best seen in FIGS. 6 and 8, the lower perforated panel 24 includes a bottom 44 that accommodates the perforations 30. A sidewall 66 connects the bottom 44 to the upper rim 46 of the lower perforated panel 24 which also features an outer flange 48. The upper rim 46 also features an inwardly extending bead 50 which provides a friction fit between the lower perforated panel 24 and the top closure panel 22. Referring to FIGS. 6 and 8 collectively, the top closure panel 22 also features a flange 52 that extends outwardly from an upper rim 54. The top closure panel 22 also features a lower panel 32 which is connected to a sidewall 58 which terminates at the upper rim 54. The sidewall 58 features a bead 62 which enhances the friction fit between the sidewall 58 of the top closure panel 22 against the sidewall 66 of the lower perforated panel 24.

Thus, referring to FIG. 10, when the top closure panel 22 is folded downward to the closed position shown in FIG. 10, the bead 62 of the top closure panel 22 engages the bead 50 of the lower closure panel 24 as the top closure panel 22 is pushed downward and then the beads 50, 62 engage one another to hold the two panels 22, 24 in a closed position. The top panel 22 is thereafter opened upon the application of manual pressure in an upward direction against the tab 28 (see FIGS. 4 and 8). Still referring to FIG. 10, the base 18 may be unitary in nature or may include multiple components. In the specific embodiment shown in FIG. 10, the base includes a bottom panel 68 which is connected to the upwardly protruding sidewall structure 40. The bottom panel 68 and sidewall 40 define a reservoir area indicated at 72 for storing the loose cosmetic powder. As noted above, the ribs 42 enhance the frictional engagement between the base 18 and the top 16. Also, the lower perforated panel 24 may include a plurality of slots indicated at 174 and disposed in the outside surface of the sidewall 66 which facilitates the insertion of the lower perforated panel 24 into the opening in the base 18 as defined by the upper rim 76.

Thus, an improved compact container 14 for accommodating loose cosmetic powder has been shown and described. The loose powder compact 14 retains the loose powder below the panel 32 of the top closure panel 22 when the compact 14 is not in use and is being transported or handled. By retaining the loose powder below the panel 32 of the top closure panel 22, a storage space is provided on top of the recessed panel 32 for accommodating a brush applicator such as the one indicated at 34. The applicator is maintained in a relatively clean condition and free of excess loose powder so that it may be picked up by the user without getting cosmetic powder on the user's hands. The recessed storage area disposed on top of the panel 32 of the top closure panel 22 also provides a convenient storage area for an applicator means such as 34 so that it may be conveniently carried between the top 16 and base portion 18 of the compact 14.

As noted above, in the loose powder compacts taught by the prior art, the powder is free to migrate upward through the perforations during transport and handling and therefore any applicator stored within the compact is normally completely covered with loose powder and further loose powder often accumulates above the perforations resulting in spillage when the user removes the top. Those frustrating difficulties have been alleviated by the present invention.

Any suitable plastic or polymer material can be used to fabricate the base 18, top 16 and retainer 20. As noted above, the base 18 can be unitary or include multiple components. The preferred material of construction for the retainer 20 is polypropylene if the hinge 26 is a living hinge. Of course, a two-piece retainer 20 which includes a separate upper closure panel 22 and lower perforated panel 24 also falls within the scope of the present invention.

Although only one embodiment of the present invention has been illustrated, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

What is claimed is:

1. A container assembly for containing and dispensing loose cosmetic powder, the container assembly comprising:

a base receptacle for accommodating loose cosmetic powder therein, the base receptacle including an upper rim which defines an opening for accommodating a retainer, a retainer including a lower perforated panel and an upper closure panel, the lower perforated panel mateably engaging the opening defined by the upper rim of the base receptacle, the upper closure panel mateably engaging the lower perforated panel when in a closed position to isolate loose cosmetic powder below the upper closure panel, a top that mateably engages the base receptacle, the retainer being disposed between the top and base receptacle when the top mateably engages the base receptacle.

2. The container assembly of claim 1, wherein the upper closure panel being hingedly connected to the lower perforated panel.

3. The container assembly of claim 2, wherein the upper closure panel of the retainer includes a recessed upper surface for accommodating a powder applicator on top of the upper closure panel when the upper closure panel mateably engages the lower perforated panel.

4. A container assembly for containing and dispensing loose cosmetic powder, the container assembly comprising:

a base, the base including a bottom panel, the bottom panel being connected to a sidewall which extends upwardly before terminating at an upper rim, the bottom panel and sidewall defining a reservoir for containing loose powder, the upper rim defining an opening for mateably engaging a retainer to prevent unwanted spillage of loose powder and to provide controlled dispensing of the loose powder, a retainer including a lower perforated panel and an upper closure panel, the lower perforated panel being mateably engaged in the opening defined by the upper rim of the base, the lower perforated panel including at least one upwardly protruding sidewall which terminates at an upper flange, the upper flange being hingedly connected to the upper closure panel, the upper closure panel mateably engaging an opening defined by the upper flange of the lower perforated panel when in a closed position to retain loose powder in a position below the upper closure panel, the upper closure panel including a recessed top surface, the recessed top surface providing a storage space for a powder brush when the upper closure panel is in a closed position, a top disposed over the retainer for enclosing the sidewall of the base.

5. A container assembly for containing and dispensing loose cosmetic powder, the container assembly comprising:

a base, the base including a bottom panel, the bottom panel being connected to a sidewall which extends upwardly before terminating at an upper rim, the bottom panel and sidewall defining a reservoir for containing loose powder, the sidewall including an inside surface, the upper rim defining an opening for mateably engaging a retainer to prevent unwanted spillage of loose powder, a retainer including a lower perforated panel and an upper closure panel, the lower perforated panel being connected to at least one upwardly-protruding sidewall which terminates at an upper flange, the upwardly protruding sidewall including an outer surface and an inner surface, the outer surface of the upwardly protruding sidewall being in abutting and frictional engagement with the inside surface of the sidewall of the base when the lower perforated panel is mateably engaged in the opening defined by the upper rim of the base, the inner surface of the upwardly protruding sidewall of the lower perforated panel featuring a bead for enhancing frictional contact between the lower perforated panel and the upper closure panel when said panels are mateably engaged, the upper flange being hingedly connected to the upper closure panel, the upper closure panel including an upwardly protruding sidewall for mateably engaging the upper flange of the lower perforated panel when in a closed position to retain loose powder in a position below the upper closure panel, the upwardly protruding sidewall of the upper closure panel including an outside surface, the outside surface including a bead for enhancing frictional contact between the upper closure panel and the lower perforated panel when said panels are mateably engaged, the upper closure panel including a recessed top portion for accommodating a powder applicator when the upper closure panel is in a closed position, a top disposed over the retainer for mateably engaging the sidewall of the base.

6. A container assembly for containing and dispensing loose cosmetic powder, the container assembly comprising:

a base receptacle for accommodating loose cosmetic powder therein, the base receptacle including an upper rim which defines an opening for accommodating a retainer, a retainer including a lower perforated panel and an upper closure panel, the upper closure panel being hingedly connected to the lower perforated panel, the lower perforated panel mateably engaging the opening defined by the upper rim of the base receptacle, the upper closure panel mateably engaging the lower perforated panel when in a closed position to isolate loose cosmetic powder below the upper closure panel, the upper closure panel of the retainer includes a recessed upper surface for accommodating a powder applicator on top of the upper closure panel when the upper closure panel mateably engages the lower perforated panel.

7. The container assembly of claim 6, further comprising a top that mateably engages the base receptacle over the retainer, the retainer being disposed between the top and base receptacle when the top mateably engages the base receptacle.

* * * * *